US008540114B2

(12) United States Patent
Sarson

(10) Patent No.: US 8,540,114 B2
(45) Date of Patent: Sep. 24, 2013

(54) CONTAINER APPARATUS WITH A BODY, PLATE, AND LID

(75) Inventor: George A. Sarson, Waterloo (CA)

(73) Assignee: Cup Techniques Ltd., Kitchener, Ontario (CA)

( * ) Notice: Subject to any disclaimer, the term of this patent is extended or adjusted under 35 U.S.C. 154(b) by 359 days.

(21) Appl. No.: 12/725,061

(22) Filed: Mar. 16, 2010

(65) Prior Publication Data

US 2010/0258564 A1 Oct. 14, 2010

Related U.S. Application Data

(60) Provisional application No. 61/161,112, filed on Mar. 18, 2009.

(51) Int. Cl.

| | |
|---|---|
| ***B65D 17/34*** | (2006.01) |
| ***B65D 43/26*** | (2006.01) |
| ***B65D 41/00*** | (2006.01) |
| ***B65D 21/00*** | (2006.01) |
| ***B65D 51/18*** | (2006.01) |
| ***B65D 3/00*** | (2006.01) |

(52) U.S. Cl.

USPC ..... 220/834; 220/839; 220/270; 220/359.2; 220/254.3; 206/508; 229/404; 229/906.1; 53/492

(58) Field of Classification Search

USPC ..... 220/839, 837, 836, 592.16, 592.17, 220/359.1, 254.1, 254.3, 841; 53/492; 229/126, 124, 906.1, 404, 400, 4.5, 128; 206/508, 509

See application file for complete search history.

(56) References Cited

U.S. PATENT DOCUMENTS

| | | | | | |
|---|---|---|---|---|---|
| 667,634 | A | * | 2/1901 | Schmidt | 229/128 |
| 2,016,964 | A | * | 10/1935 | Huffman | 413/22 |
| 3,474,928 | A | * | 10/1969 | Hurtt | 206/508 |
| 4,141,462 | A | * | 2/1979 | Rucci | 220/254.1 |
| 4,418,862 | A | * | 12/1983 | Vesborg | 229/110 |
| 4,573,631 | A | * | 3/1986 | Reeves | 229/404 |
| D306,975 | S | * | 4/1990 | Brondyke et al. | D9/431 |
| 5,358,175 | A | * | 10/1994 | Cai | 229/117.14 |
| 5,363,982 | A | * | 11/1994 | Sadlier | 229/103.11 |
| 5,660,326 | A | * | 8/1997 | Varano et al. | 229/403 |
| 5,667,094 | A | * | 9/1997 | Rapchak et al. | 220/834 |
| 5,697,550 | A | * | 12/1997 | Varano et al. | 229/403 |
| RE35,830 | E | * | 6/1998 | Sadlier | 220/592.17 |
| 5,960,987 | A | * | 10/1999 | Solland et al. | 220/834 |
| 5,964,400 | A | * | 10/1999 | Varano et al. | 229/403 |
| D417,845 | S | * | 12/1999 | Sadlier et al. | D9/447 |
| D418,368 | S | * | 1/2000 | Solland et al. | D7/510 |

(Continued)

FOREIGN PATENT DOCUMENTS

| | | | |
|---|---|---|---|
| DE | 10202705 A1 | * | 8/2003 |
| GB | 2269811 A | * | 2/1994 |
| WO | WO 8500791 A | * | 2/1985 |

OTHER PUBLICATIONS

Roth et al., The Packaging Designer's Book of Patterns, Copyright 2000, Second Edition, pp. 42 and 43.*

*Primary Examiner* — Robin Hylton

(57) ABSTRACT

A container apparatus and a method for using the container apparatus is disclosed. The disclosed apparatus can be implemented in a wide variety of ways, including but not limited to that of a food or beverage container. The container apparatus can include a lid and a body that are integral to each other.

16 Claims, 14 Drawing Sheets

(56) References Cited

U.S. PATENT DOCUMENTS

| | | | | |
|---|---|---|---|---|
| 6,085,970 | A * | 7/2000 | Sadlier | 229/403 |
| 6,164,488 | A * | 12/2000 | Solland et al. | 220/834 |
| 6,176,420 | B1 * | 1/2001 | Sarson et al. | 229/128 |
| 6,196,454 | B1 * | 3/2001 | Sadlier | 229/403 |
| 6,257,485 | B1 * | 7/2001 | Sadlier et al. | 229/403 |
| 6,378,766 | B2 * | 4/2002 | Sadlier | 229/403 |
| 6,422,456 | B1 * | 7/2002 | Sadlier | 229/403 |
| 6,592,504 | B2 * | 7/2003 | Sarson et al. | 493/104 |
| D492,509 | S * | 7/2004 | Anderson et al. | D6/448 |
| 6,758,390 | B2 * | 7/2004 | Sarson et al. | 229/128 |
| D502,364 | S * | 3/2005 | Chan | D7/511 |
| 6,955,289 | B2 * | 10/2005 | Green | 229/128 |
| 7,014,044 | B1 * | 3/2006 | Sadlier | 206/546 |
| 7,175,042 | B2 * | 2/2007 | Durdon | 220/254.3 |
| 7,246,716 | B2 * | 7/2007 | Durdon | 220/254.3 |
| D596,022 | S * | 7/2009 | van den Berg | D9/416 |
| 7,661,580 | B1 * | 2/2010 | Bazan | 229/149 |
| 7,726,551 | B2 * | 6/2010 | Abbott | 229/404 |
| 7,767,049 | B2 * | 8/2010 | Sadlier | 156/205 |
| D642,864 | S * | 8/2011 | Tobias | D7/510 |
| 2004/0011862 | A1 * | 1/2004 | Sarson et al. | 229/404 |
| 2004/0253346 | A1 * | 12/2004 | Amato | 426/89 |
| 2005/0173507 | A1 * | 8/2005 | Green | 229/404 |
| 2005/0224386 | A1 * | 10/2005 | Close | 206/508 |
| 2006/0169759 | A1 * | 8/2006 | Sarson et al. | 229/400 |

* cited by examiner

CONTAINER APPARATUS WITH A BODY, PLATE, AND LID

RELATED APPLICATIONS

This utility patent application claims priority to the provisional patent application titled "PRODUCT CONTAINER CUP WITH A FOLD-DOWN HINGED LID" (Ser. No. 61/161,112) that was filed on Mar. 18, 2009, the contents of which are hereby incorporated by reference in its entirety.

BACKGROUND OF THE INVENTION

The invention relates generally to containers. More specifically, the invention is a container apparatus and a method for using the same.

Many products cannot be stored, transported, sold, and/or used without first being secured in some type of container. Some types of products, such as many types of food products and virtually all beverage products, require some type of container for the product to be handled or consumed. As the number of products offered to consumers and businesses continues to grow, the shapes, sizes, configurations, and numbers of containers also grow.

A wide variety of different containers can be used to secure a wide range of different product types. The purposes of product containers can include preventing damage to or disbursement of the contained product. A container can product the product, the user of the product, or collateral property or people. The attributes of a product will often impact the attributes of a container used to house the product, and vice versa. For example, a container for a beverage product will typically need to be watertight while a container used for storing office supplies need not be watertight or even fully closed. Similarly, a container suitable for use in the context of sterilized medical supplies will have different attributes than a container used to store spare change or golf tees.

Different containers can have different anticipated users of different skill levels, and thus proper usage of a container can vary widely depending on whether or not the anticipated user of the container is a consumer. For example, a beverage container used in fast food restaurants will need to be suitable for use by individual consumers, a wide cross section of the population that includes persons with disabilities as well as individuals of below average physical and mental capabilities. In contrast, a container used by locksmiths or mechanics to store their tools can utilize far more complex designs and operating procedures.

Containers also vary widely in terms of their anticipated duration of service. Many containers are disposed of after a single use. For example, a cup of ice cream sold in a grocery store or drug store is intended to be thrown away after the contents are consumed by a consumer. In contrast, a thermos can be emptied and filled repeatedly for many years.

Many consumer products are sold in disposable containers that are not biodegradable or that otherwise involve negative environmental implications. Many consumer product containers end up as litter that is both an eyesore and damaging to the environment. For example, the Great Pacific Garbage Patch which is also often referred to as the Pacific Trash Vortex is made up of high concentrations of plastics and other debris trapped by the currents of the North Pacific Gyre. Whether or not the size of the Pacific Trash Vortex is currently as large as the state of Texas, there is no disputing that the area is large and the damage to that area is significant. Moreover, there are four other large places in the world's oceans where winds trap floating debris. Whether discarded in a land fill or on a body of water, plastic containers such as water bottles, plastic lids for paper cups, and other once-used disposable containers for consumer products can take centuries to degrade, while doing significant damage to the surrounding eco-system in the interim. Billions of plastic bottles end in U.S. landfills each year. If those bottles are laid end-to-end, there are plastic bottles disposed of each year to circle the equator hundreds of times or to reach the moon and back multiple times. Old habits die hard, and it is difficult to change both business and consumer behavior with regards to disposable containers. There are thousands of coffee shops in the U.S. who in the aggregate sell millions of coffee servings each year with paper or Styrofoam cups that utilize plastics lids.

It would be desirable for better containers to be used to store products, including but not limited to the context of disposable containers.

SUMMARY OF THE INVENTION

The invention relates generally to containers. More specifically, the invention is a container apparatus and a method for using the same.

The container includes a plate that connects the lid of the container to the body of the container. The lid, plate, and body of the container can be implemented in a wide variety of different configurations to properly store a wide variety of different products. The container can be made of a wide variety of different materials including but not limited to paper or paperboard.

BRIEF DESCRIPTION OF THE DRAWINGS

The following drawings illustrate different examples of various embodiments of the apparatus.

DETAILED DESCRIPTION

The invention relates generally to containers. More specifically, the invention is a container apparatus (the "container") and a method for using the same.

I. Overview

The container apparatus (the "container") can be implemented in a wide variety of different shapes, sizes, and configurations. Different embodiments of the container can be used for the storage, transportation, and/or use of a wide variety of different products. A container can be used to store food products, beverages, money, office supplies, electronics, tools, chemical products, cleaning detergents, fabric softeners, and virtually any other type of solid, liquid, or even in certain circumstances, gas product.

Different embodiments of the container can be comprised of a wide variety of different materials. For example, in the context of a container serving as a cup, the cup could be comprised of paper, paperboard, stainless steel, metal, ceramics, plastics, or other types of materials. Different types of coatings such as polymer coatings, high barrier polymer coatings (including but not limited to high carrier silver coatings), polyethylene coatings (including but not limited to polyethylene terephthalate coatings), biopolymer coatings (including but not limited to polyactide polymers), biodegradable polyester, and other types of coatings can be used with respect to the container.

Containers provide an excellent opportunity for businesses and other organizations to facilitate communications. In many instances, the container will include text, graphics, and other indicia to communicate brand identity, product information, marketing information, or public service announcements. As miniature electronic components become increasingly easy and inexpensive to incorporate into containers, some containers can be configured to provide audio communications using technology similar to that used to play music when someone opens a greeting card. A container can also be configured to use powered electronics to flash lights or otherwise generate visual indicia. For example, a coffee cup container could be configured to play a song, flash a light, and/or generate some other response upon the opening or closing of the lid.

In accordance with the provisions of the patent statutes, the principles and modes of operation of the container have been explained and illustrated in a variety of embodiments and configurations. However, it must be understood that this inventive container may be practiced otherwise than is specifically explained and illustrated without departing from its spirit or scope.

II. Introduction of Elements and Definitions

Figure 1A:
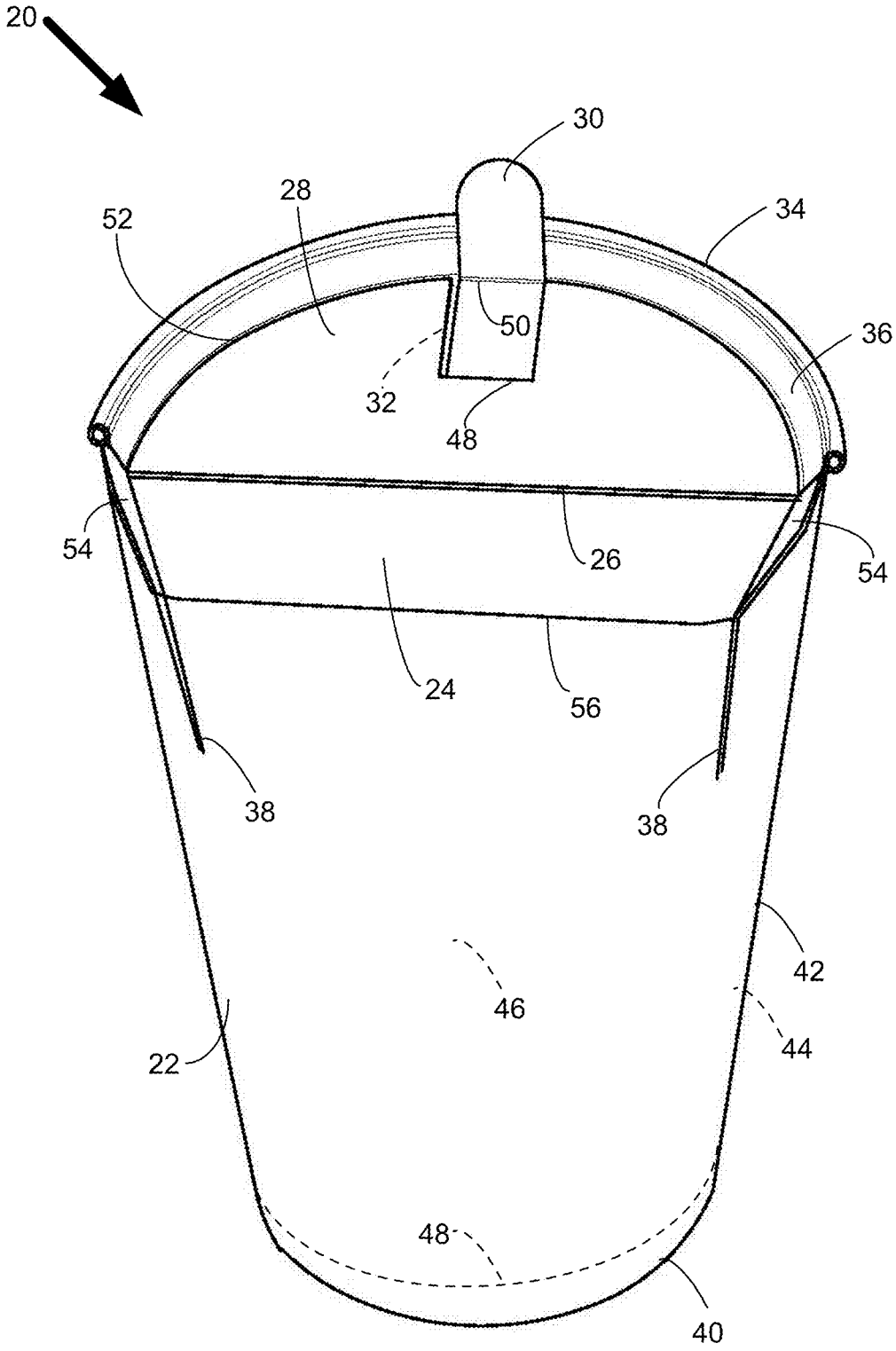
FIG. 1*a* is a perspective diagram illustrating an example of a container in a fully closed state.

FIG. 1*a* is a perspective diagram illustrating an example of a container 20 in a fully closed and sealed state. The container 20 illustrated in FIG. 1*a* is a cup that can be machined from and/or into a single piece of paperboard. Different embodiments of the container 20 can involve different types of products, different material compositions, and different manufacturing processes. Each embodiment of the container 20 will include a container body (the "body" 22) and a lid 28. The body 22 and lid 28 can be implemented in a wide variety of different shapes and sizes. All other components in the various Figures are optional and need not be included in all embodiments of the container 20. Most embodiments of the container 20 will also include a plate 24 that is connected to both the lid 28 and to the body 22, with one end of the plate 24 being connected to the lid 28 and the other end of the plate being connected to the body 22. In some embodiments, the lid 28 and even the plate 24 can be configured to be removable from the container 20, such as through perforated edges to a paperboard material that can be removed by hand. In other embodiments, the body 22, lid 28, and plate 24 are integral to each other and are not configured to be separable from each other.

A. Body

The body 22 of the container 20 typically constitutes the majority of the surface area of the container 22. The body 22 of the container 20 also typically defines the shape, size, and contours of the container 20. For example, in FIG. 1 the container 20 is a coffee cup that is substantially cylindrical in shape. The shape of the container 20 is the result of a substantially cylindrical body 22. The body 22 of the container 20 may include various score lines for the purposes of reinforcing the structural strength and integrity of the container 20. Unlike other components of the container 20, the body 22 is not designed to be movable or otherwise configurable by the user of the container 20. In other words, the body 22 of the container 20 remains the same regardless of which operating state or configuration that the container 20 is in. In contrast, the lid 28, the plate 24, and their respective components can be moved and configured by the user of the container 20.

The bottom portion of the body 22 typically serves as the base of the container 20 with the lid 28 being placed in a vertical position that is higher than most or even all of the body 22, depending on the particular embodiment of the container 22. In FIG. 1*a*, the uppermost portion of a tab 30 (which can extend off of and be part of the lid 28) represents the highest vertical point on the container 20 in a conventional orientation of the container 20 when the container 20 is in a fully closed operating configuration/state. Conversely, the lowest vertical portion of the container 20 illustrated in FIG. 1 is a base surface 40 of the body 22 upon which the container 20 sits when placed on a flat surface such as a table.

The body 22 of the container 20 can itself be broken down further into various components and elements.

1. Cavity

A cavity 46 (which can also be referred to as a chamber 46) is the empty space within the body 22 of the container 20 that is used to store the product. For example, in the context of a coffee cup container 20, the cavity 46 is the space within the body 22 that houses the coffee. In FIG. 1*a*, the cavity 46 is illustrated with a dotted line because an exterior surface 42 of the body 22 blocks the view of the cavity 46 within the body. In many embodiments of the container 20, the cavity 46 will be shaped in a substantially identical manner to the outer appearance of the body 22. However, in alternative embodiments, different shapes and configurations can be implemented, particularly if the container 20 requires structural reinforcements to maintain the integrity of the body 22. In such instances, reinforcing structures may be placed within the body 22, altering its interior shape, i.e. the shape of the cavity 46.

Some embodiments of the container 20 can include multiple cavities 46 for separating two or more products within the container 20. Such embodiments can include internal structures to mix the contents if desired, or to keep them permanently separate. For example a container 20 could be configured to hold 2 different and separate drinks, with the cavity 46 being split into two separate holding areas.

2. Rim

As illustrated in FIG. 1*a*, a rim 34 can represent the highest vertical position of the body 22. The rim 34 is typically a reinforced exterior surface at the top of the body 22. Some embodiments of the container 20 will not include a rim 34, but the rim 34 is often useful for strengthening and reinforcing the structural integrity of the container 20. Rims 34 can also aid users in the use of the container 20. For example, in the context of a cup container 20 used to hold a beverage, the rim 34 can assist a drinker in avoiding a spill as well as making the coffee cup container more comfortable to use. The rim 34 can also insulate the drinker from a beverage that is particular hot or particular cold.

In the illustration of FIG. 1*a*, the rim 34 is on top of a portion 36 of the body 22 that is vertically higher than the lid 28 when the lid 28 is in a fully closed configuration/state. The top portion 36 of the body 22 often includes a variety of score lines, which can be vertical, horizontal, or a combination thereof.

In some embodiments of the container 20, the rim 34 will cover the entire portion of the body 22 that is not covered by the plate 24 or a flap 54. In other embodiments of the container 20, coverage of the rim 34 is not comprehensive, allowing in certain embodiments, the portion 36 of the body 22 closest to the flaps 54 to be folded inwardly to reinforce the functionality provided by the flaps 54. To maximize the flexibility of the plate 24 and or flaps 54, it is often desirable for at least a couple of millimeters of the top portion 36 to not be covered by the rim 34.

In many embodiments of the container 20 that involve a cylindrical or substantially cylindrical body 22, the rim 34 forms an arc between approximately 299 degrees and approximately 180 degrees. In many embodiments of the container 20 that involve cylindrical or substantially cylindrical body 22, the lid 28 will form between approximately between 180 degrees and 299 degrees of a circle.

3. Surfaces

A body 22 is made up of both exterior surfaces and interior surfaces. An exterior surface is a surface of the body that faces outward from the container 20. An interior surface is a surface of the body 22 that faces inward towards the body 22, typically the cavity 46 or another interior surface.

In FIG. 1*a*, one exterior surface 42 of the body 22 is the portion of the body 22 that is substantially cylindrical in shape that runs from a bottom to the top of the body 22. A corresponding interior surface 44 that is illustrated with a dotted line because it is not visible from the exterior of the container 20 is also cylindrical in shape and runs from a bottom to the top of the container 20.

The portion 36 of the body 22 that extends upwards from the closed lid includes both an exterior surface as well as an interior surface. The portion 36 of the body 22 that extends upwards in a vertically higher position than the lid 28 in a closed state can be referred to as a vertical protrusion 36 of the body 22. The rim 34 rests on the vertical protrusion 36.

The bottom portion of the body 22 includes both interior surfaces (facing upwards towards the cavity 46) and exterior surfaces (facing downwards towards the surface on which the container 20 rests). The bottommost exterior surface of the body 22 is referred to as a base 40. The bottommost interior surface of the body 22 (which can also be thought of as the bottommost exterior "surface" of the cavity 46) is referred to as a floor 48. The floor 48 of the cavity is illustrated with a dotted line in FIG. 1*a* because the cavity 46 is not visible from the outside of the container 20. A wide variety of different designs can be incorporated into the base 40 of the container. Two different examples are provided in FIGS. 4*a* and 4*b*, which are discussed below.

4. Score Lines

Returning to FIG. 1*a*, the body 22 of the container 20 can include a variety of different score lines to reinforce the strength of the body 22 or for other purposes. The lid 28 and plate 24 components can also include score lines as used in the body 22 of the container 20. In the context of the plate 24 or lid 28, a score line can be used to facilitate the ability of a user to move a particular component, to transition the container 20 from one operating state to another. In the context of the body 22, the purpose of a score line is to prohibit movement or deformation.

Score lines can be oriented vertically or horizontally. Score lines can be full or only partial. For example, a full horizontal score line could run across the entire circumference of a cylindrical body 22. In contrast, a partial horizontal score line may be limited to running under only through the portions of the body 22 that are directly under the plate 24, the plate 24 and flaps 54, the rim 34, or some other component or element. A horizontal score line 56 (which can also be referred to as a fold 56 or connector 56) is often used to connect the plate 24 to the body 22. The boundary between a flap 54 and the body 22 can also be marked by the connector 56 or fold 56, although different score lines could be used. It is often helpful to include horizontal score lines on the body 22 of the container 20 that are parallel to the score line serving as the connector 56 between the plate 24 and the body 22 because the connector 56 between the plate 24 and the body 22 is often important in supporting the ability of the plate 24 to support the movement of the lid 28.

Some embodiments of the container 20 can include horizontal score line 52 (which can also be referred to as the lid groove 52 or a lid channel seat groove 52) to better secure the position of the lid 28 in a closed configuration/state. FIG. 5*c* provides one example of a shape of a lid groove 52 that can be incorporated into the container 20. Different shapes of lid grooves 52 and score lines can be incorporated into different embodiments of the container 20.

Vertical score lines can similarly be full (running from top to bottom) or merely partial. As illustrated in FIG. 1*a*, vertical score lines 38 in the body 22 can run extend upwards to the plate 38 to reinforce the structural integrity of the plate 24 and the ability of the plate 24 to assist in securing the lid 28 in a closed position. Some embodiments of the container 20 may include full vertical score lines spaced evenly throughout portion of the body 22 covered by the rim 34.

B. Plate and Flaps

A plate 24 is a surface area of the container 20 that is configured to support the movement of the lid 28. Just as the body 22 can have exterior surfaces facing in an outward direction and interior surfaces facing in an inward direction, the plate 24 can include but an outward surface and an inward surface. Similarly, the plate 24 can also include both vertical and horizontal score lines with the boundaries of the plate 24 being typically marked by score lines. A plate 24 can include vertical score lines and horizontal score lines. The plate 24, as well as the flaps 54 (if any), serve collectively as a hinge mechanism that allows the lid 28 to be opened and closed.

In many embodiments, two flaps 54 will be located horizontally adjacent to the plate 24, with one flap 54 to each side of the plate.

The plate 24 and two flaps 54 that are illustrated in FIG. 1*a* facilitate the ability of users to open and close the lid 28 while facilitating the strength and tightness of the container 20. If the lid 28 cannot be secured in a closed position, then the ability to utilize the container 20 is compromised because an unfastened lid 28 can result in the unintended change of an operating configuration/state from closed to open. For example, in the context of a beverage container 20, a container 20 that cannot be closed and sealed in a watertight manner is of only limited use.

Embodiments of the container 20 that include a plate 24 allow for the lid 28 to be open or closed without altering the structure of the lid 28. By leaving the structure of lid 28 unchanged, the structural integrity of the lid 28 and the ability of a closed lid 28 to seal the contents of the cavity 46 are enhanced. The motion of the lid 28 is facilitated by the plate 24 or the plate 24 in conjunction with the flaps 54. A variety of score lines are typically used to delineate the boundaries of the plate 24 and flaps 54. A score line 26 between the plate 24 and the lid 28 can be referred to as a hinge 26. Whether the plate 24 an/or flap 54 configuration is utilized with respect to a particular container 20, the aggregate effect of that plate 24 and flap 54 configuration is to serve as a hinge.

As discussed above, different embodiments of the container 20 can utilize different types of score lines at different locations with different attributes.

1. Flaps

A flap 54 is a surface horizontally adjacent to the plate 24, but separate from the plate 28 by a vertical or substantially vertical score line. The boundaries of the flaps 54 are often demarcated by vertical and horizontal score lines. As discussed above, one or more flaps 54 may be used to support and enhance the ability of the plate 24 to function as a hinge for the lid 28. Some embodiments of the flaps 54 can be configured to be further twisted or pushed in by the user to further secure the lid 28 in a closed position. Such twisting or pushing in may render the container 20 undesirable for subsequent opening and refilling.

An embodiment of the container 20 that uses a plate 24 need not include any flaps 54, but a combination of one plate 24 with one flap 54 on each side is often desirable.

2. Skid locks

Figure 8:
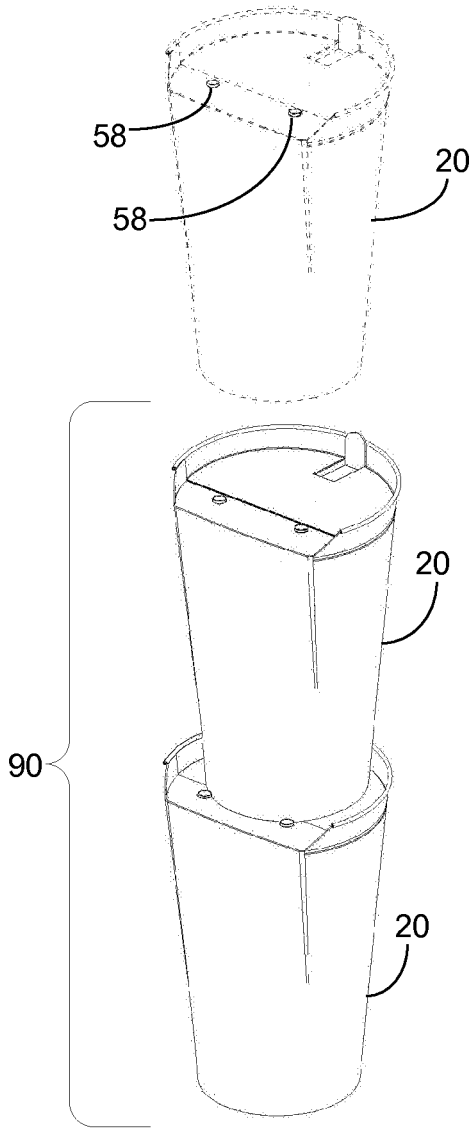
FIG. 8 is a diagram illustrating an example of skid locks facilitating a vertical stack of closed containers.

Some embodiments of the plate 24 can include one or more skid locks 58 to facilitate the ability of users to stack the containers 20 on top of each other even if the lids 28 are closed. FIG. 8 illustrates an example of a container 20 with 2 skid locks 58 configured to support a stack 90 of closed containers 20.

3. Score Lines

Returning to FIG. 1*a*, score lines can be used to delineate the plate 24 from other components. The connector 56 as discussed above is used to connect the body 22 to the plate 24. A hinge score line 26 (which can also be referred to as the hinge 26) can be used as the boundary between the lid 28 and the plate 24. In many embodiments of the container 20, the hinge 26 is configured to be more maneuverable than the connector 56 because the relative motion of the lid 28 with respect to the plate 24 is typically far greater than the relative motion of the plate 24 with respect to the body 22. The purpose of the plate 24 is to insulate the body 22 from the magnitude of movement required by the lid 28.

C. Lid

A lid 28 is the means by which a container 20 is closed and in some cases, sealed (such as the case with watertight containers). In some embodiments, a grove 52 in the body 22 helps secure the lid 28 when it is moved to a closed/sealed position. Although the position of the lid 28 determines whether the container 20 is in a closed state/configuration or an open state/configuration, the change in the position of the lid 32 is not achieved through any structure change to the lid 32. To the contrary, it is the plate 24 (sometimes in conjunction with the flaps 54) that serve as the hinge upon which the lid 28 can be moved. In the example of FIG. 1*a*, the lid 28 moves by being rotated around the hinge 26.

In many embodiments of the container 20, the lid 28 is substantially circular in shape and need not be very thick. In many embodiments of the container 20, the lid 28 is substantially parallel to the surface on which the container 20 rests when the lid is in a closed operating configuration/state.

The lid 28 can be in an open position, a closed position, or in some instances, a partially open/partially closed position. In many embodiments of the container 20, the lid 28 is integral to the plate 24, and the plate 24 is integral to the body 22. The lid 28 can be comprised of the same material as the plate 24 and body 22.

1. Tab

Some embodiments of the lid 28 can include a tab 30 which serves as a handle for opening and closing the lid 28. Different embodiments of the tab 30 can include a different number of score lines. In many embodiments, the number of score lines in the tab 30 will depend on whether the tab 30 is used to seal an opening 32 in the lid 28. As illustrated in FIG. 1*a*, the tab 30 includes a score line 48 at the base of the tab 30 as well as a score line at the segment 50 of the tab 30 that transitions from a primarily horizontal orientation to a primarily vertical orientation. This allows the tab 20 to facilitate the sealing and closing of the opening 32 as well as the opening and closing of the lid 28. In many beverage embodiments of the container 20, an additional third tab score line 60 (see FIG. 3) can be used to facilitate the ability of the user to push the tab 30 down into the opening 32 so that the tab 30 does not interfere with the comfort of the user in drinking the beverage in the container 20.

Returning to FIG. 1*a*, the tab 30 is fastened to the lid 28 at a tab base 48. The location of the tab base 48 can depend on whether or not the lid 28 includes an opening 32. If the lid 28 does include an opening 32, then the tab base 48 is typically the innermost edge of the opening 32. If the lid 28 does not include an opening 32, then the tab base 48 is typically located close to the outermost edge of the top surface of the lid 28.

The container 20 illustrated in FIG. 1*a* includes both a tab 30 and an opening 32. The shape of the tab 30 can vary widely, but the tip of the tab 30 should serve to facilitate movement by the user and the shape of the lower portion of the tab 30 will typically depend on the shape of the opening 32.

2. Opening

Some embodiment of the lid 28 will include an opening 32 to selectively expose the contents of the container 20. For example, in the context of a beverage container, the opening 32 can allow the user to drink the contents of the container 20 (through use of a straw or by simply tipping the container in close proximity to an open mouth) while the lid 28 remains in a closed position. The opening 32 can be closed/sealed using the tab 30. The opening 32 in FIG. 1*a* is illustrated with a dotted line because the opening 32 is not visible. The opening 32 in FIG. 1*a* is filled up and sealed by the tab 30. The bottom portion of the tab 30 in FIG. 1*a* from the tab base 48 to the fold 50 is substantially parallel to the bottom surface of the container 20 and the top portion of the tab 30 from the fold 50 upwards protrudes straight upwards in the air where it can be most easily grasped.

The shape of the opening 32 and of the portion of the tab 30 used to plug the opening 32, can vary widely from embodiment to embodiment. Some embodiments of the container 20 can include more than one opening 32. For example, some embodiments of a beverage container 20 could include two or more openings 32 for the insertion of straws.

Figure 1B:
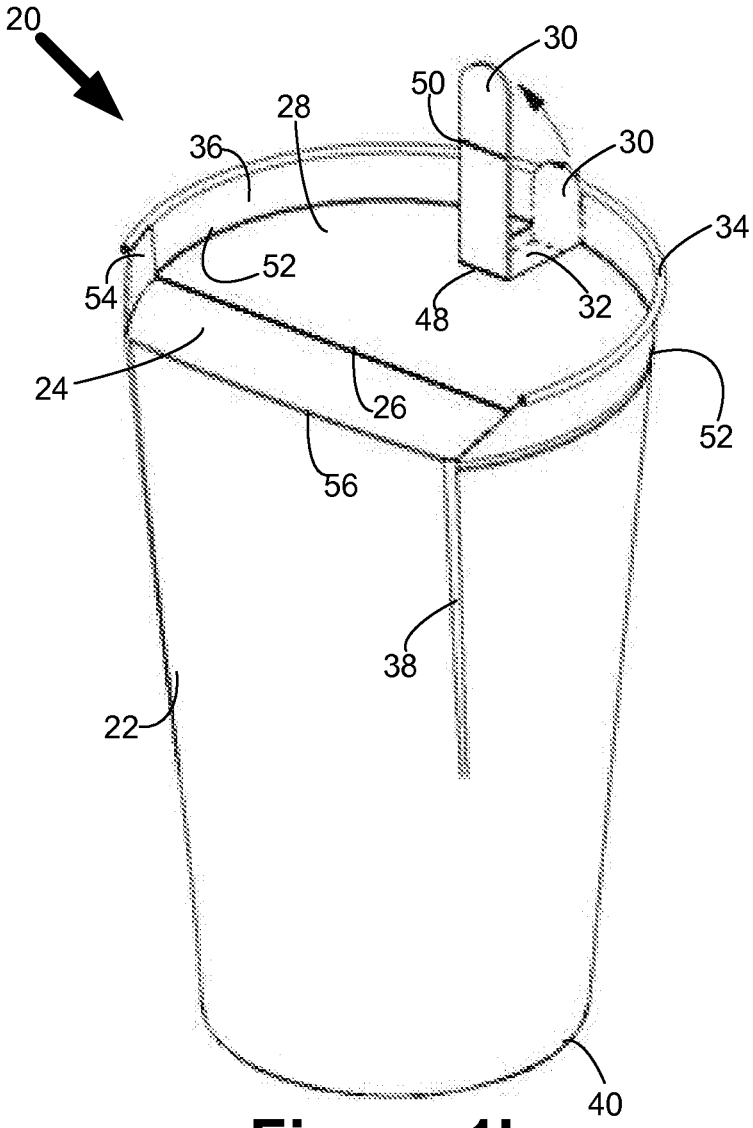
FIG. 1*b* is a perspective diagram illustrating an example of a container in a fully closed state except for an opened opening.
Figure 6:
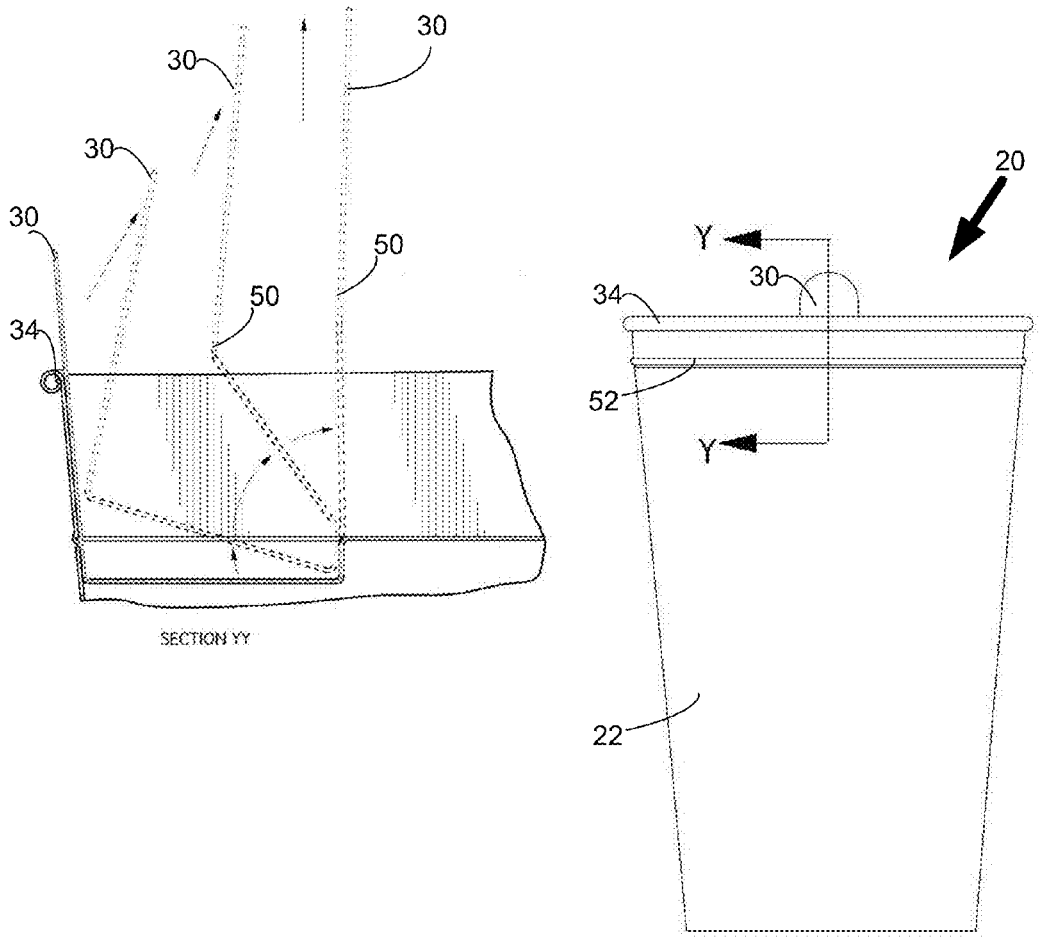
FIG. 6 is diagram illustrating an example of a front view of a container and an example of tab in various positions.

Additional illustrations of the movement of the tab 30 and the opening 32 covered by the tab 30, can be seen in FIG. 1*b* and FIG. 6.

D. Additional Elements/Components

Different embodiments of the container 20 can include a wide variety of additional elements/components. As discussed above, different score line configurations can be incorporated into the container 20. In some embodiments, a tear back adhesive can be place on the lid 28 to facilitate the pulling open of the lid 28. The structure and shape of the lid channel seat groove 52 can be modified to provide extra reinforcement analogous to that of a girdle. For example, additional structural components could be added to prevent the lid 28 from moving beyond a particular closed position.

In some embodiments, a vertical body seam running up from the bottom of the body 22 to the outermost portion of the lid 28 and the location of the tab 30 could be used to further strengthen the container 20. In some embodiments, the vertical body seam can include a lateral tab to facilitate the opening and closing of the container 20.

For embodiments involving the storage of food, the flaps 54 can include a cold seal adhesive that is water based. Pressure from the fingers of the users can then form a bond that will enhance the ability of the container 20 to satisfy specification 276.170 FDA compliance as it pertains to direct food contact with respect to aqueous and fatty foods.

III. Operating Configurations/States/Positions

Depending on the product that a container 20 is designed to secure, the container 20 can be configured in a variety of different states or positions. For example, in the context of a beverage container 20, the container 20 can be in a fully closed and sealed position to minimize the ability of the beverage to escape from the container. An example of the fully closed and sealed configuration is illustrated in FIG. 1*a*, where the lid 28 is closed and the opening 32 is also sealed by the tab 30 which can include a variety of score lines designed to facilitate the ability of the tab 30 to fill the opening 32.

FIG. 1*b* illustrates an example of a lid 28 that is fully closed, but an opening 32 that is not blocked by the tab 30, permitting the beverage to be consumed, but otherwise limiting the ability of the beverage to be spilled. As illustrated in the Figure, the tab 30 is straightened out into a vertical or substantially vertical position as the opening 32 is unsealed. As discussed below with respect to FIG. 3, some embodiments of the tab will include an additional score line 60 designed to facilitate the pushing of the tab 30 into the opening 32 so that the tab 30 does not interfere with the drinking of the beverage through the opening 32. The transition from FIG. 1*a* to FIG. 1*b* can occur solely with the movement of the tab 30.

Figure 1C:
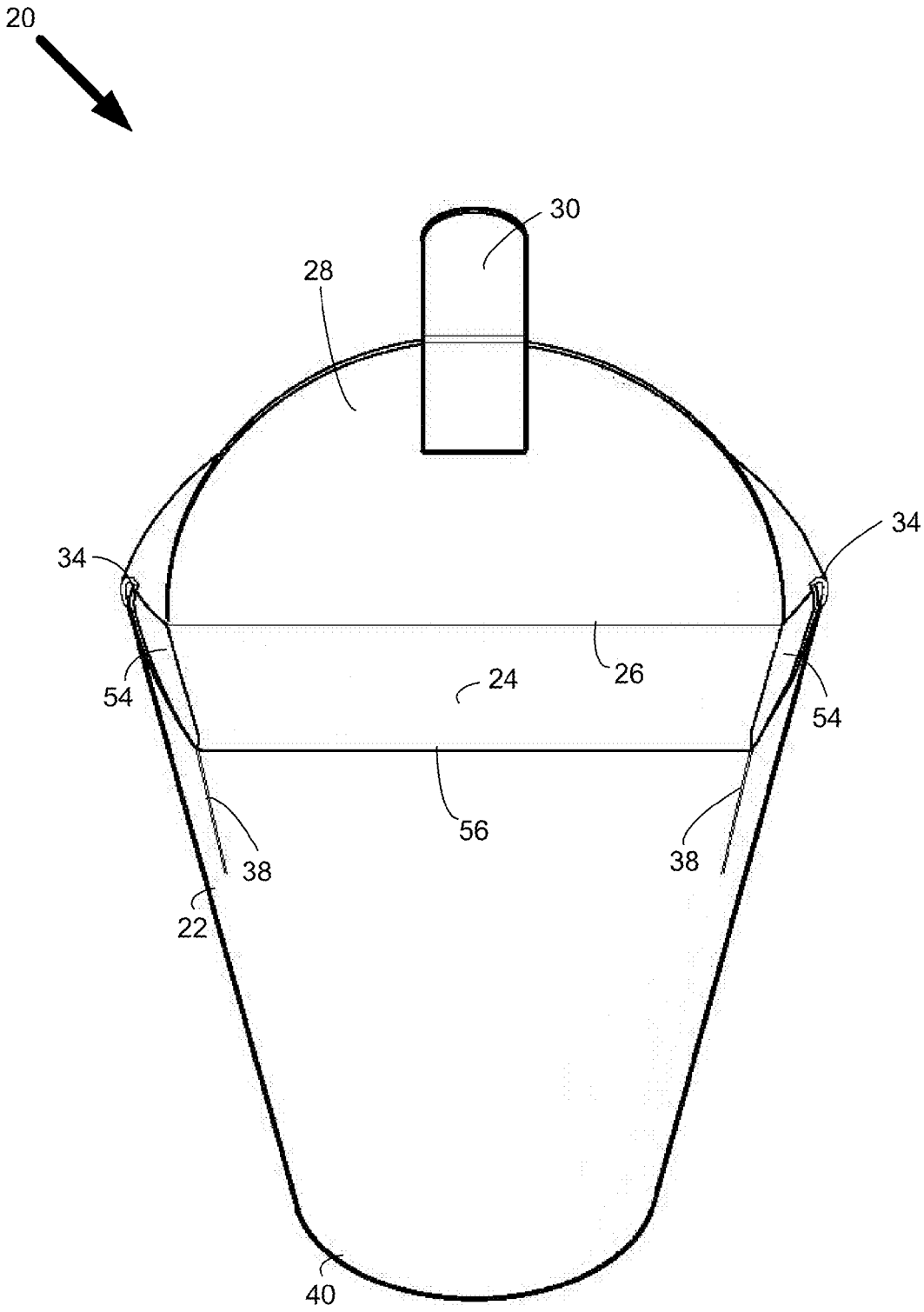
FIG. 1*c* is a perspective diagram illustrating an example of a container in a partially open and partially closed state.

FIG. 1*c* illustrates an example of a lid 28 that is partially open. Although the position of the plate 24 in FIG. 1*c* is identical to the position of the plate 28 in FIG. 1*b* and FIG. 1*a* because the plate 24 is fixed, the lid 28 is nonetheless not in a closed position. In many contexts, the filling or refilling of the beverage container 20 is performed while the container 20 is in the configuration of FIG. 1*c*. In some contexts, a user may drink from the container 20 while in the state illustrated in FIG. 1*c*. The transition from FIG. 1*b* to FIG. 1*c* involves movement of the lid 28 but not the movement of the plate 24.

Figure 1D:
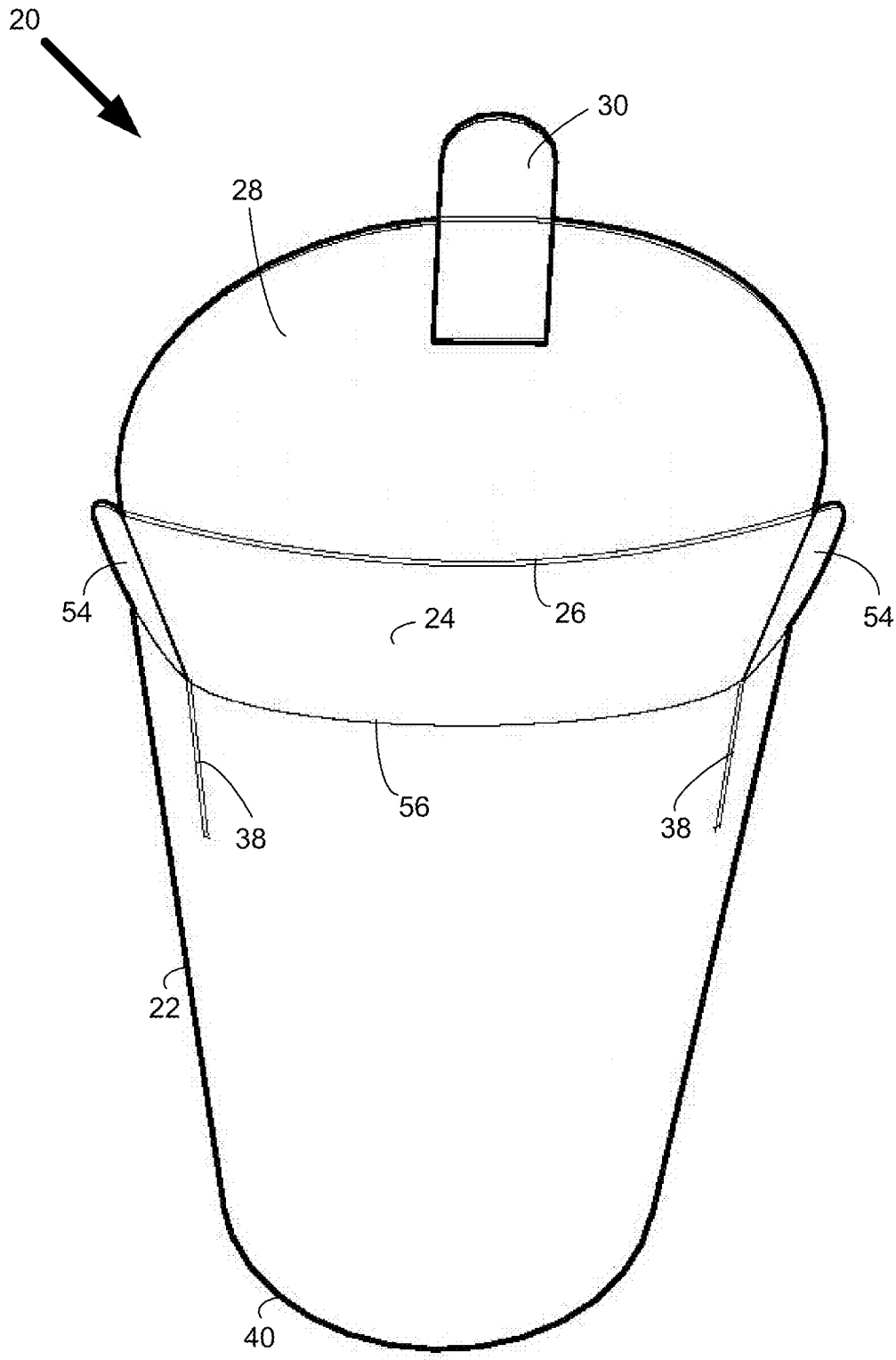
FIG. 1*d* is a perspective diagram illustrating an example of a container in a fully open state.

FIG. 1*d* illustrates an example of a container 20 in a state of maximum openness. The illustrated configuration can be highly desirable for the purposes of stacking empty containers 20 on top of each other. The illustrated configuration can also be desirable in the filling or refilling of the container 20, and in some instances, such as trying to clear out a cup of the remaining portions of a milk shake, for consuming the contents of the container 20. The transition from FIG. 1*c* to FIG. 1*d* involves primarily the moving of the plate 24 from its substantially horizontal position to its substantially vertical position.

Different embodiments of the container 20 can include a wide variety of different positions, states, and operating configurations.

IV. Method of Making

Many paperboard embodiments of the container 20 can be machined from either pre-printed, pre-punched blanks or optional pre-printed roll stock. The blank can be precisely positioned and tightly wrapped around the folding mandrel. The design of some cup embodiments of the container 20 allows for the body 22 wrapping with the punched and drawn cup bottom inserted prior to sidewall sealing or optional insertion of the cup bottom after the side wall sealing. Sealing of the side-seam and bottom seam is completed by utilizing e.g. flame, hot air or ultrasonic. Sealing parameters related to temperature, pressure and registration is critical within the forming process. The cup shells can be designed to facilitate easy transfer between multiple turret stations positioned on the cup forming machine. The partially finished cup can then transferred to the top curl turret, incorporating multiple stations to form the top curl rim 34: lubrication, pre-curl, finishing curl and calibration.

V. Method of Using

Different containers 20 can involve different components and different steps for the opening and closing of the container 20.

A. Example #1

Figure 2A:
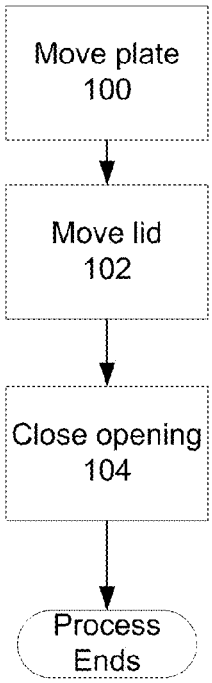
FIG. 2*a* is a flow chart diagram illustrating an example of a method for closing a container.

FIG. 2*a* is a flow chart diagram illustrating an example of a method for closing a container 20. At 100, the plate 24 is moved into the position that the plate would be in if the container 20 is closed. An example of step 100 would be the transition from the configuration illustrated in FIG. 1*d* to the configuration illustrated in FIG. 1*c*.

Returning to FIG. 2*a*, at 102, the lid 28 is moved into the position that the lid 38 would be in the container 20 is closed. An example of the step 102 would be the transition from the configuration illustrated in FIG. 1*c* to the configuration illustrated in FIG. 1*b*.

Returning to FIG. 2*a*, at 104, the opening 32 is closed with the tab 30. An example of step 104 would be the transition from the configuration illustrated in FIG. 1*b* to the configuration illustrated in FIG. 1*a*.

The loading or filling to the container 20 could occur while in potentially any of the states identified above.

The closing/sealing process ends after the closing of the opening 32.

B. Example #2

Figure 2B:
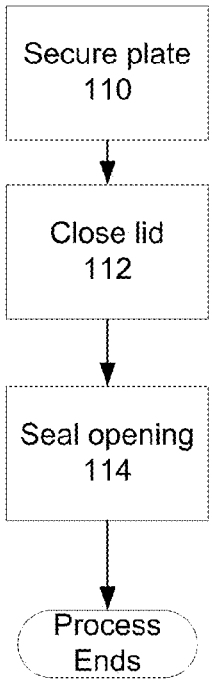
FIG. 2*b* is a flow chart diagram illustrating an example of a method for closing a container.

FIG. 2*b* is a flow chart diagram illustrating an example of a method for closing a container 20. At 110, the plate 24 is secured into the position that the plate 24 would be in if the container 20 is closed. This typically involves the user pressing down on the plate 24, pivoting the position of the plate 24 along the boundary 56 between the body 22 and the plate 24. An example of step 110 would be the transition from the configuration illustrated in FIG. 1*d* to the configuration illustrated in FIG. 1*c*. It is often desirable to load or fill the container 20 before performing this step.

Returning to FIG. 2*b*, at 112, the lid 28 is closed. This can be done by pressing down on the lid 28 and rotating the lid 28 around the hinge 26 marking the boundary between the lid 28 and the plate 24. An example of the step 112 would be the transition from the configuration illustrated in FIG. 1*c* to the configuration illustrated in FIG. 1*b*.

Returning to FIG. 2*b*, at 114, the opening 32 is closed and sealed with the pushing in of the tab 30. Alternative embodiments may include additional mechanisms by which the opening 32 is sealed. An example of step 114 would be the transition from the configuration illustrated in FIG. 1*b* to the configuration illustrated in FIG. 1*a*.

The closing/sealing process is completed with the sealing of the opening 32 at 114.

C. Example #3

Figure 2C:
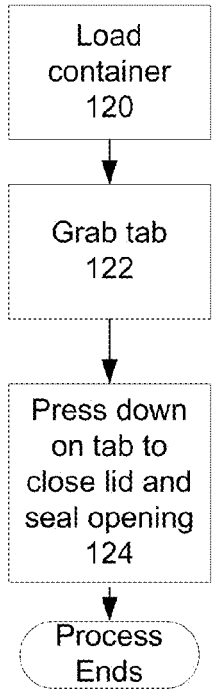
FIG. 2*c* is a flow chart diagram illustrating an example of a method for closing a container.

FIG. 2*c* is a flow chart diagram illustrating an example of a method for loading and closing a container 20. At 120, cavity 46 of the container 20 is loaded or filled with the applicable product. This step is typically performed while the container 20 is in a state of maximum openness.

At 122, the user grabs the tab 30.

At 124, the user presses down on the tab to move the plate 24 to a closed position, to move the lid 28 to a closed position, and to fill the opening 32 with the bottom portion of the tab 30. This can be done in one motion by the user.

The process ends with the fully closed and sealed container 20.

VI. Additional Views

A. Top view

Figure 3:
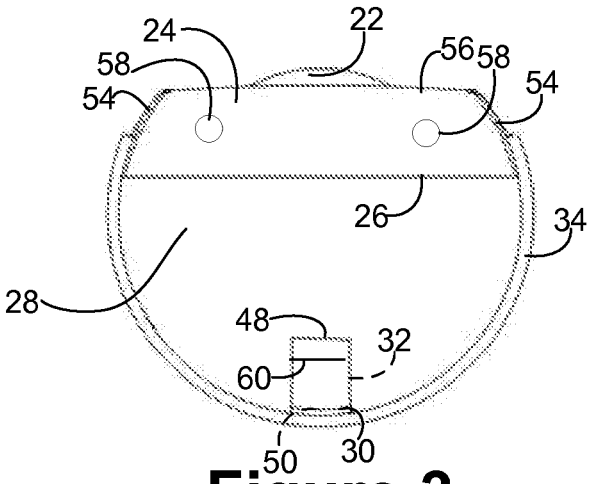
FIG. 3 is a diagram illustrating an example of a top view of container.

FIG. 3 is a diagram illustrating an example of a top view of container 20. In this example of the container 20, the tab 30 includes three score lines (48, 60, and 50) to facilitate the ability of a user to push the tab 30 down into the opening 32 so that the tab 30 does not enter the users mouth or otherwise interfere with the consumption of the beverage.

The illustration in FIG. 3 also includes two skid locks 58 to facilitate the stacking of closed containers 20 as illustrated in FIG. 8.

B. Bottom View

Figure 4A:
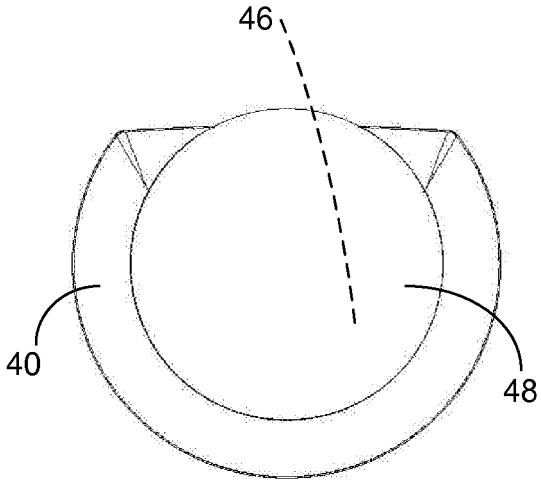
FIG. 4*a* is a diagram illustrating an example of a bottom view of a container.
Figure 4B:
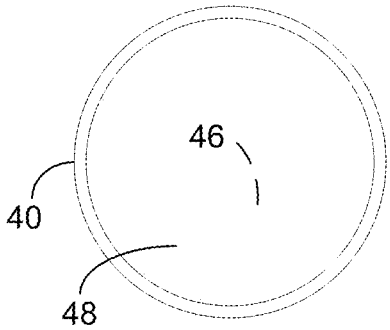
FIG. 4*b* is a diagram illustrating an example of a bottom view of a container.

FIG. 4*a* is a diagram illustrating an example of a bottom view of a container 20. FIG. 4*b* is a diagram illustrating another example of a bottom view of a container 20. Each illustration shows the base 40 as well as the bottom exterior surface 48 of the cavity 46. As illustrated in the Figures, different base 40 configurations can be incorporated into different embodiments of the container 20. The type of material used to comprise the container 20 and the type of contents anticipated to be held in the container 20 can influence the appropriate design of the bottom of the container 20.

C. Side View

Figure 5A:
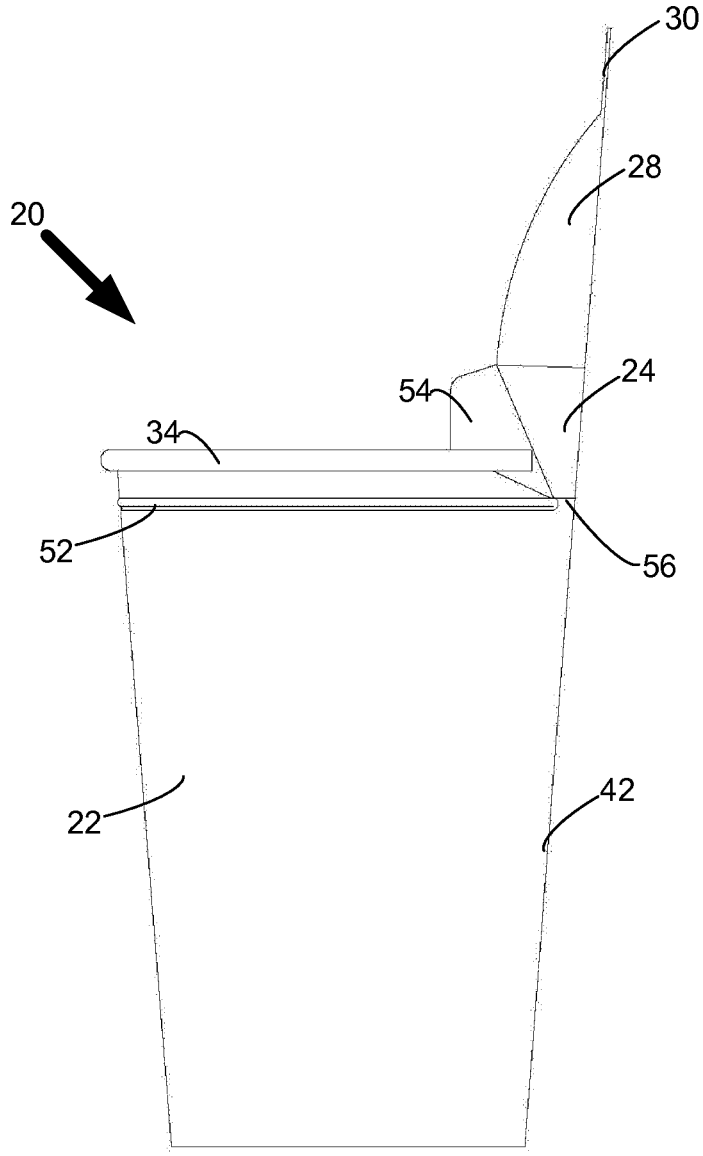
FIG. 5*a* is a diagram illustrating an example of a side view of a container.

FIG. 5*a* is a diagram illustrating an example of a side view of a container 20. The container 20 in FIG. 5*a* is in a similar operating state/configuration as the container 20 in FIG. 1*d*, but from a different perspective. In this position, the portions of the tab 30, lid 28, and plate 28 that are most exterior to the container 20 form a substantially vertical line segment extending upwards from the exterior surface 42 of the body 22.

Although the lid 28 is substantially flat when closed, the curvature of the container 20 does not appear substantially as a line segment in a side view of the container 20 when the lid 28 is in a full upright position.

Figure 5B:
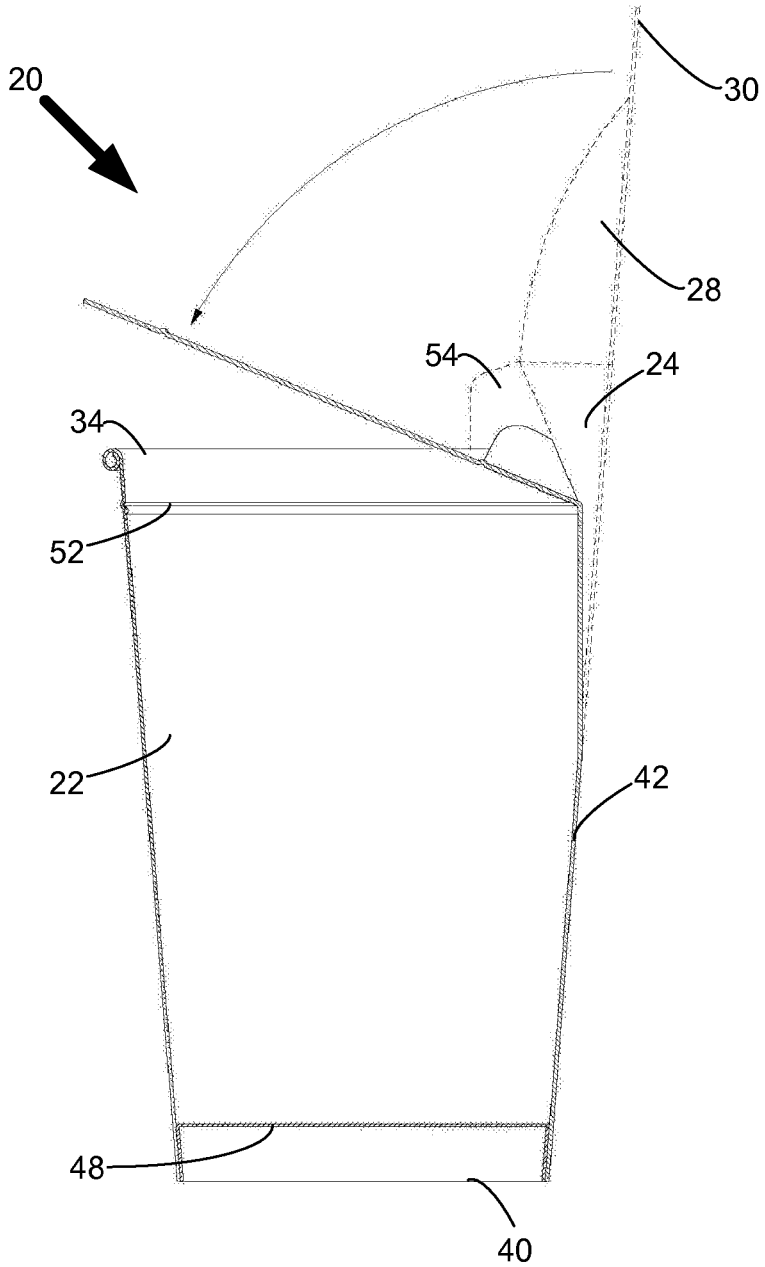
FIG. 5*b* is a diagram illustrating an example of a side view of a container.
Figure 5C:
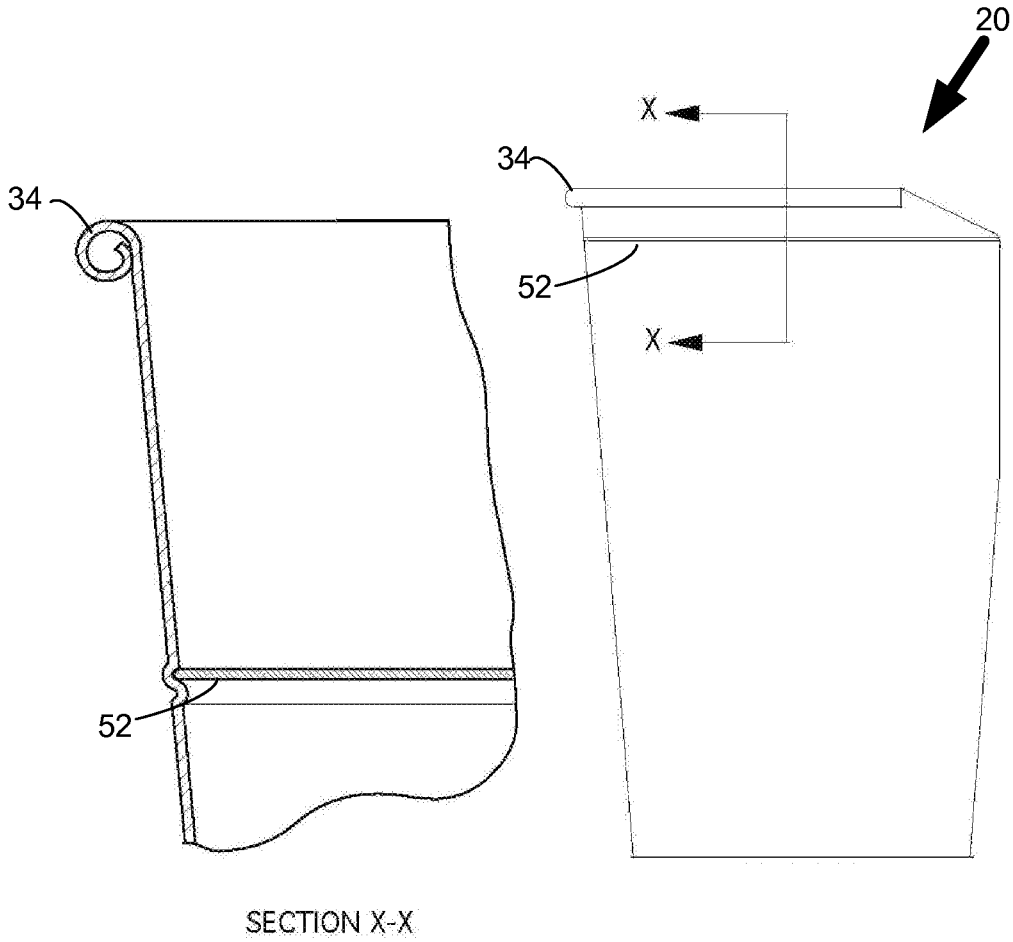
FIG. 5*c* is a diagram illustrating an example of a side view of a closed container with a horizontal score line functioning a lid channel seat groove to secure the lid in a closed position.

However, as illustrated in FIG. 5*b*, as the lid 28 moves more closely to a closed position, the side view of the lid 28 takes on a more two-dimensional appearance.

FIG. 5*c* is a diagram illustrating an example of a side view of a interior body surface that includes a lid channel seat groove 52 to secure the lid 28 in a closed position. Different geometric shapes can be incorporated into the groove 52. Additional structures can also be added to preclude the lid 28 from moving beyond an optimal closed position.

D. Front View

FIG. 6 is a diagram illustrating an example of a front view of a container 20. The Figure also illustrates the different positions of the tab 30 as the container 20 transitions from closed and sealed (FIG. 1*a*), to closed and unsealed (FIG. 1*b*), open lid/plate secure (FIG. 1*c*), and fully open (FIG. 1*d*).

E. Back View

Figure 7:
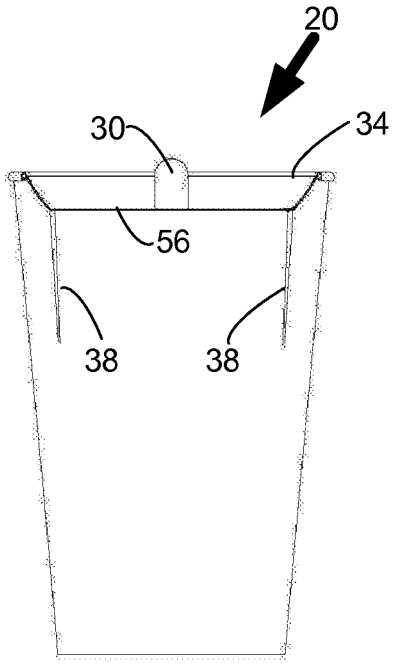
FIG. 7 is a diagram illustrating an example of a back view of a container.

FIG. 7 is a diagram illustrating an example of a back view of a container 20. The container 20 in FIG. 7 is in a fully closed and sealed position.

F. Stacked Containers

FIG. 8 is a diagram illustrating an example of skid locks 58 facilitating the vertical stacking of closed containers 20. The number of closed containers 20 that can be included into a stack 90 will depend on a variety of factors, including the design of the container 20, the structural strength of the container 20, and the contents (if any) in the container 20.

Figure 9A:
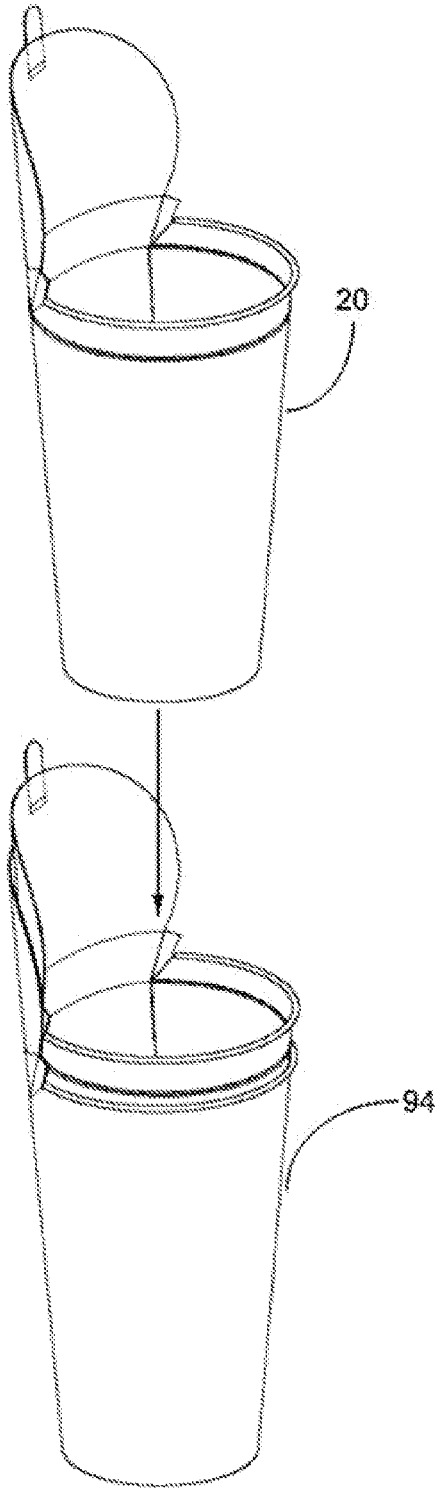
FIG. 9*a* is a diagram illustrating an example of a vertical stack of open containers.

FIG. 9*a* is a diagram illustrating an example of the vertical stacking of open containers 20. A stack 94 of open containers 20 can typically include far more containers 20 than a stack 90 of closed containers 20.

Figure 9B:
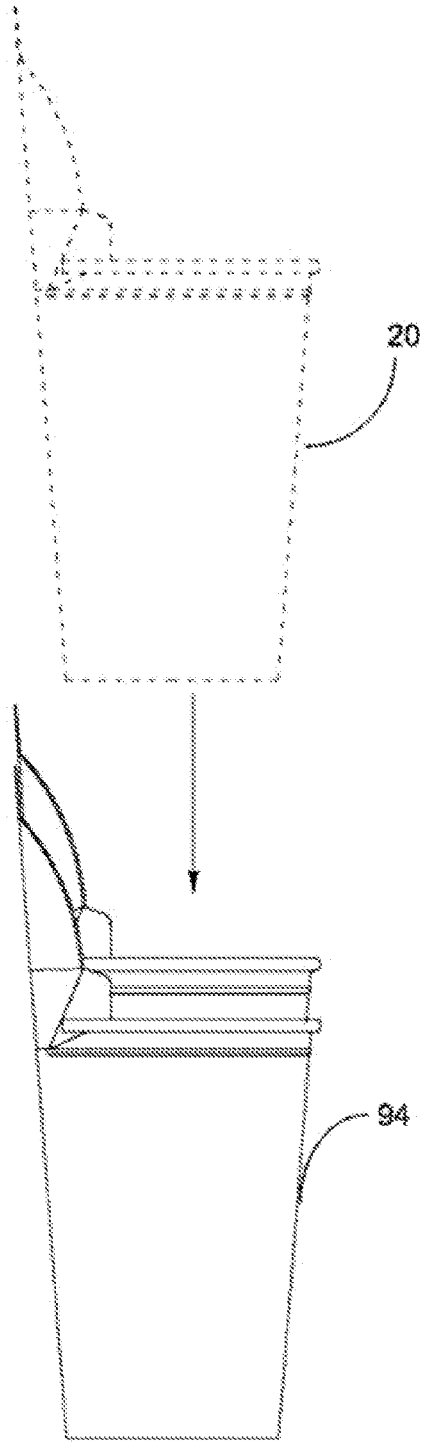
FIG. 9*b* is a diagram illustrating an example of a vertical stack of open containers.

FIG. 9*b* is a diagram illustrating an example of a stack 94 of open containers 20 from a different perspective.

VII. Alternative Embodiments

The container can be implemented in a wide variety of different embodiments, configurations, and contexts. In accordance with the provisions of the patent statutes, the principles and modes of operation of this invention have been explained and illustrated in a variety of embodiments and configurations. However, it must be understood that this invention may be practiced otherwise than is specifically explained and illustrated without departing from its spirit or scope. The container and methods for using the container can be implemented in a wide variety of different components, component configurations, and component compositions.

The invention claimed is:

1. A container, comprising:

a plurality of components, said plurality of components including a body, a lid, a plate, and a plurality of flaps connected to said body;

said plurality of flaps comprising a first flap and a second flap;

said lid comprising a curved edge; and a plurality of foldable score lines, said plurality of foldable score lines including a connector, a hinge, and a plurality of side score lines;

said plurality of side score lines including a first side score line and a second side score line;

wherein said plate is connected to said hinge, said connector, said first side score line, and said second side score line;

wherein said hinge connects said lid to said plate;

wherein said connector connects said plate to said body;

wherein said first side score line connects said first flap to said plate;

wherein said second side score line connects said second flap to said plate; and wherein said body provides for holding a substance.

2. The container of claim 1, wherein said body has a curved shape and wherein said body includes an inner cavity that is sealed by said lid when said lid is in a closed position.

3. The container of claim 1, said body including an inner groove that provides for securing said curved edge of said lid when said lid is in a closed position.

4. The container of claim 1, wherein said body does not provide for being folded.

5. The container of claim 1, said body further comprising a rim, wherein said rim is entirely positioned vertically above said lid when said lid is in a closed position.

6. The container of claim 1, said body including a cavity for securely holding a liquid, wherein said substance in said body is said liquid in said cavity, and wherein said container is comprised of paperboard.

7. The container of claim 1, said body comprising: a cavity within said body; a curved rim fixed to the top of said body; and a curved inner groove for securing said curved edge of said lid in a closed position.

8. The container of claim 7, wherein said curved rim is not connected to said plate and wherein said curved rim is not connected to said lid.

9. The container of claim 1, wherein said lid does not provide for being separable from said container, wherein no said score line separates said body from said first flap, and wherein no said score line separates said body from said second flap.

10. The container of claim 1, said container further comprising a tear back adhesive portion and an outwardly extending tab located on a top surface of said lid, wherein said tear back adhesive portion and outwardly extending tab provides for moving said lid.

11. The container of claim 1, said body including a substantially vertical score line running up to said plate, wherein said substantially vertical line provides for supporting said plate, and wherein said substantially vertical score line does not provide for folding.

12. The container of claim 1, said container further comprising a tab attached to said lid, wherein said tab provides for moving said lid.

13. The container of claim 1, said container further comprising a plurality of skid locks attached to said plate to facilitate the stacking of said container while in a closed position.

14. The container of claim 1, wherein said container is a disposable cup, wherein said body is curved, wherein said lid is comprised of paperboard, and wherein said lid is not adapted to be removable from said container.

15. A container, comprising:

a plurality of components, said plurality of components including a body, a lid, a plate, and a plurality of flaps connected to said body;

said lid comprising a curved edge;

said plurality of flaps comprising a first flap and a second flap;

said body comprising a rim, an inner groove, and an inner cavity that provides for securing a liquid;

said lid comprising a curved edge; and a plurality of foldable score lines surrounding said plate, said plurality of foldable score lines including a connector, a hinge, and a plurality of side score lines;

said plurality of side score lines including a first side score line and a second side score line;

wherein said hinge connects said lid to said plate;

wherein said connector connects said plate to said body;

wherein said first side score line connects said first flap to said plate;

wherein said second side score line connects said second flap to said plate;

wherein said inner groove provides for securing said curved edge of said lid in a closed position; and wherein said rim is positioned vertically above said inner groove.

16. The container of claim 15, wherein said container is a disposable cup comprised of paperboard.

* * * * *